United States Patent [19]

Adamson

[11] 4,109,715

[45] Aug. 29, 1978

[54] SYSTEM AND APPARATUS FOR EXTRACTING OIL AND THE LIKE FROM TAR SANDS IN SITU

[76] Inventor: James Sidney Adamson, 539-47th Ave. SW., Calgary, Canada, T2S1C5

[21] Appl. No.: 745,691

[22] Filed: Nov. 29, 1976

[30] Foreign Application Priority Data

Dec. 5, 1975 [CA] Canada ..... 241290

[51] Int. Cl.[2] ..... E21B 43/00; E21C 41/00

[52] U.S. Cl. ..... 166/177; 166/223; 175/55; 299/5; 299/17

[58] Field of Search ..... 166/249, 306, 223, 177; 175/55; 299/4, 5, 17

[56] References Cited

U.S. PATENT DOCUMENTS

| | | | |
|---|---|---|---|
| 2,796,129 | 6/1957 | Brandon | 166/249 |
| 2,822,158 | 2/1958 | Brinton | 299/5 |
| 3,049,185 | 8/1962 | Herbold | 175/55 X |
| 3,076,513 | 2/1963 | Heaphy | 175/55 X |
| 3,199,592 | 8/1965 | Jacob | 166/306 |
| 3,666,014 | 5/1972 | Beard | 166/306 |

*Primary Examiner*—Ernest R. Purser

*Assistant Examiner*—William F. Pate, III

*Attorney, Agent, or Firm*—Stanley G. Ade

[57] ABSTRACT

The method includes circulating steam, solvent or fluids through a material such as sand while constantly agitating the material to scrub and wash entrained substances such as oil, bitumen or the like free whereupon the substances are carried back to the surface. A vibrating probe assembly is utilized which is highly maneuverable and which fluidizes the sand immediately surrounding same thus facilitating the movement of the probe and assisting in the scrubbing and separating action of the solvents or steam upon the sand. The probe includes means for extending same into the sand to the bottom of a well bore so that the vibration in conjunction with the probe configuration moves the probe through the sand in a horizontal plane or, if desired, up and down at an angle from the horizontal. The voids remaining in the clean sand are filled with water so that the probe floats on the surface of the water. The substances which have been separated from the sand normally float on the water to the well bore and thence may be elevated to the surface by the pressure of the steam, solvent or fluid circulation.

22 Claims, 10 Drawing Figures

SYSTEM AND APPARATUS FOR EXTRACTING OIL AND THE LIKE FROM TAR SANDS IN SITU

BACKGROUND OF THE INVENTION

This invention relates to new and useful improvements in the extraction of substances from a formation in situ and although directed primarily for use in tar sands, may be utilized in other mineral separation environments if desired.

There is presently no proven method of economically extracting the bitumen or oil from the tar sands in situ. Some of the methods which are proposed, require the sand to be pumped to the surface for processing and then returned to the excavation after cleaning. Other methods suggest heating the tar sands by steam or heat to make the oil flow to well bores surrounding the injection well.

However, all of these methods require large expenditures and are time consuming and as yet have not been perfected to a degree where they would make the tar sands an economic source of oil.

SUMMARY OF THE INVENTION

The present process and apparatus will extract the oils or bitumen from the tar sands without the removal of the sands from the bed. Alternatively, the apparatus can be used to loosen the oil or bitumen bearing sand which can then be freely pumped to the surface for processing by conventional means. However, the preferred method proposed circulates steam, solvents or fluids through the sands while constantly agitating the sands so that a scrubbing and washing action is provided. The oil which is then separated from the sands is then carried back to the surface.

The apparatus utilizes a vibrating probe which is highly manoeuverable and which can be directed to the working face or through the sands to thoroughly separate the oil therefrom. This probe performs these functions while completely submerged or buried in the sands and the probe agitates and cleans the sands along its length thereby making an open channel for oil and the solvent solution or the like, to return to the well bore and thence to the surface.

The voids between the clean sand particles below the probe are then filled with water and the probe, which is buoyant, floats on this water surface in a horizontal plane.

Furthermore, it is upon this water surface that the oil which has been removed from the sands, floats to the well bore.

The vibrating probe assembly is adapted to bore directly into the sands at any desired angle from the base of the well bore and then to move in a circle around the vertical axis of the well bore due to the vibrating action and due to the cross sectional configuration of the probe.

It has been found that the probe does not receive a great deal of abrasion or wear because the sand in solution with water, oil and the like, is agitated in a relatively loose state in proximity of the probe and is no longer held in the original tight matrix of bitumen.

The vibration of the probe in the present process fluidizes the sand and then due to its streamline shape, moves through the sand due to the vibration of the probe. This fluidizing of the sand also enables the probe to take advantage of the buoyancy thereof and to remain level on the water surface while working at the bitumen face thus providing a continuous operation.

The probe may revolve around the bore in a circle and can be raised with each revolution until the entire bed has been agitated and the oil removed and replaced with water while the probe's vibration packs the clean sand back into position.

The present method and apparatus therefore provides a practical and economical process for the recovery of oils and bitumens from tar sands in situ.

Also the method and apparatus can be used in other mineral separation environments. Furthermore, the vibrating probe assembly can be used with advantage, on commercial sludges in pipes, conduits or the like or in any manufacturing maintenance environment requiring this particular action.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

Before proceeding with the description of the preferred embodiment, it should be stressed that although the specification and drawings describe the method and apparatus as being used in a mineral formation such as tar sands, nevertheless the device can be used in manufacturing maintenance where sludges and the like accumulate in pipes, channels, vessels etc. For example the vibrating probe hereinafter to be described can be used to assist in the cleaning out of sewer pipes and the like.

DETAILED DESCRIPTION

Figure 1:
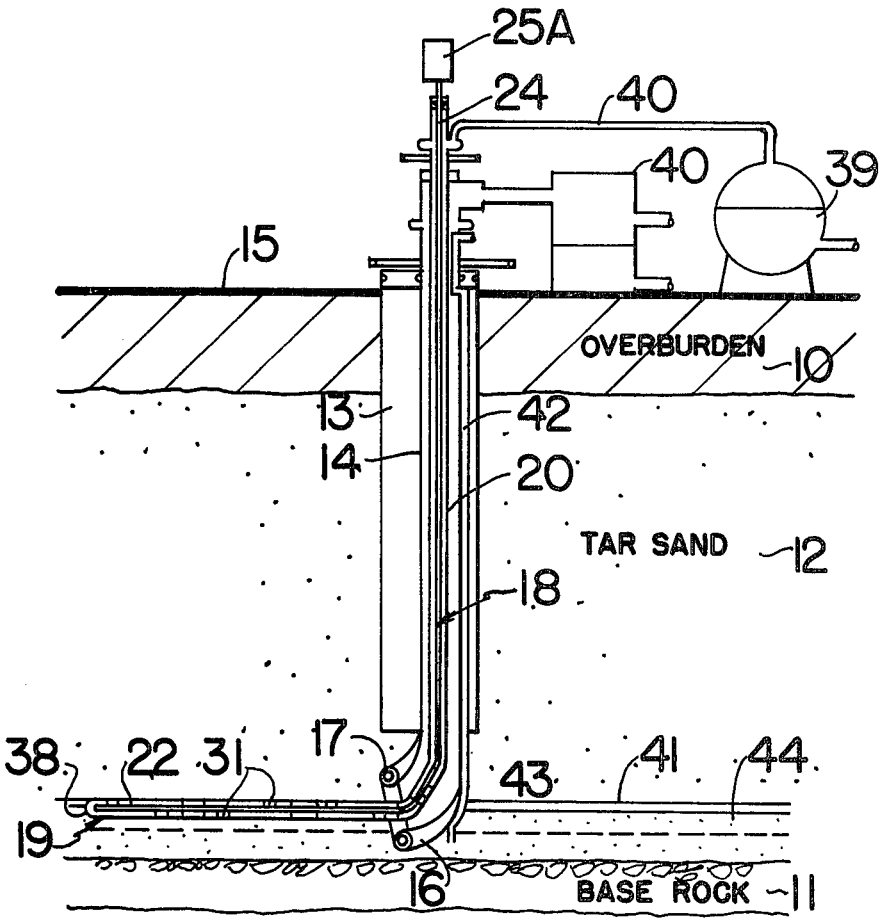
FIG. 1 is a schematic cross sectional view of the device in position.

Proceeding therefore to describe the invention in detail, reference should first be made to FIG. 1 which shows schematically, a tar sand formation including the overburden 10, the sedimentary rock or base 11 of the formation and the sedimentary bed 12 of tar sand which may be up to 200 feet in depth.

A well bore 13 is drilled downwardly through the overburden to adjacent the base of the bed 12 and a directional casing 14 is then extended downwardly through this well bore and supported by conventional means on the surface 15 of the overburden 10.

The lower end of this casing is turned substantially at right angles as illustrated by reference character 16 and a plurality of rollers 17 are journalled around the open end of this portion 16 of the casing, the purpose of which will hereinafter become apparent.

Figure 6:
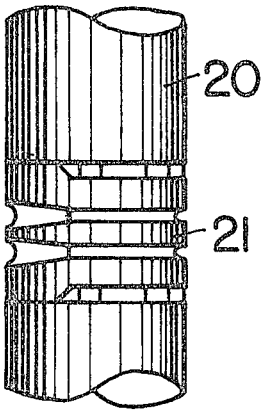
FIG. 6 is a fragmentary side elevation showing the flexible connection between the main probe assembly and the lower end portion thereof.

A vibrating probe assembly collectively designated 18 is provided and extends downwardly through the directional casing 14. The lower end portion 19 of this probe assembly is secured to the main portion 20 by means of an elastomeric or other resilient universal joint 21 and shown in detail in FIG. 6.

Figure 3:
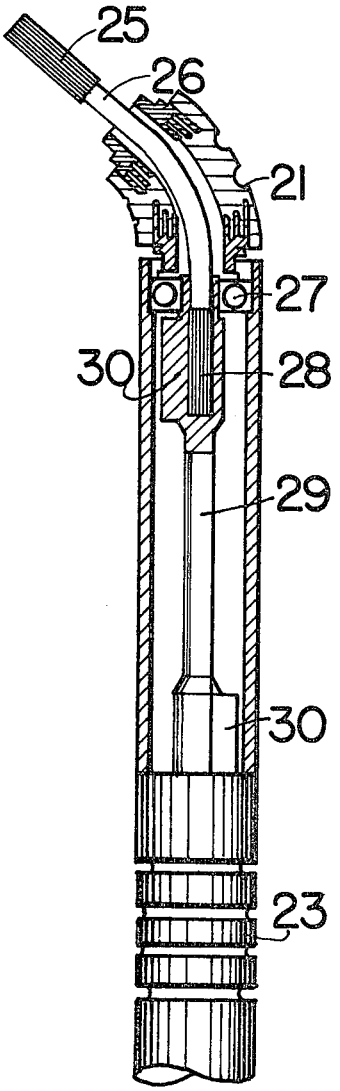
FIG. 3 is an enlarged fragmentary cross sectional view of the lower end portion of the probe assembly.

The main portion 20 takes the form of an extension casing whereas the lower end portion 19 is made up of a plurality of segments 22 connected together by flexible or resilient joints 23 shown in FIG. 3 which are similar to the aforementioned universal joints 21.

As the vibrating probe assembly is lowered downwardly through the directional casing 14, the portion 16 causes it to turn at right angles and the rollers 17 facilitate the emergence of the lower end portion 19 in a substantially horizontal manner as illustrated in FIG. 1.

The penetration of this lower end portion through the tar sand initially, may be facilitated by vibrating the lower end portion as will hereinafter be described.

Figure 7:
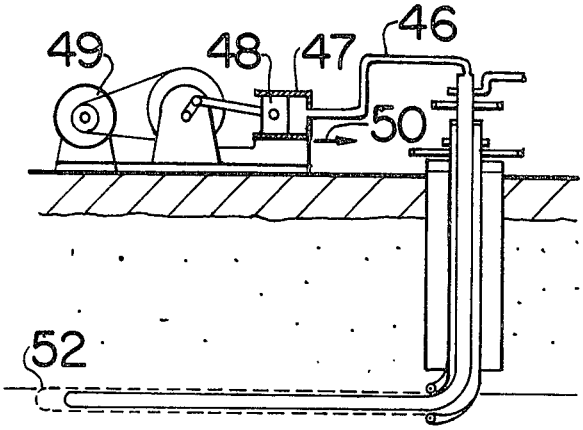
FIG. 7 is a fragmentary schematic view illustrating a further method of vibrating the lower end portion of the probe assembly.
Figure 8:
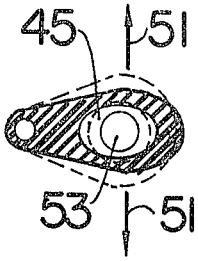
FIG. 8 is an enlarged fragmentary cross sectional view of the lower end portion of the probe assembly of FIG. 7.

FIG. 1 shows one method of vibrating the lower end portion whereas FIGS. 7 and 8 show an alternative method. However, it will be appreciated that these probes may also be vibrated by any other method such as steam, electric or pneumatic, etc.

Dealing first with the method shown in FIG. 1, a drive shaft 24 extends downwardly through the probe assembly casing 20 and is rotated by means of a source of power in the form of a motor 25A shown schematically in FIG. 1.

This drive shaft 24 connects via a flexible connection 25, to a flexible shaft 26 which is supported within bearings 27 (see FIG. 3) at one end of the lower end portion 19.

A spine section 28 is connected to the substantially horizontal drive shaft 29 which in turn is provided with a plurality of weights 30 along the length thereof which, when rotated by the shaft 24, causes vibration to occur within the lower end portion.

Flexible connections between the drive shaft portions 29 of adjacent sections 22 of the lower end portion, connect the weighted shafts 29 together and the weights in adjoining probe ends are oriented in the same direction as shown by reference character 31 in FIG. 1, thus preventing any dampening effect to the vibrator.

This vibration assists in the initial extension of the lower end portion 19 through the tar sand layer as hereinbefore described.

Figure 5:
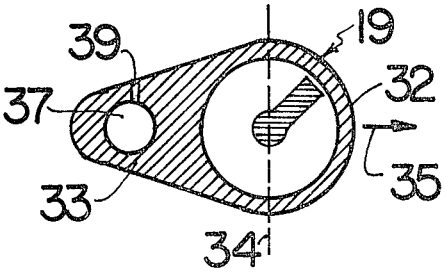
FIG. 5 is an enlarged cross sectional view of the preferred embodiment of the vibrating probe assembly.

Reference to FIG. 5 shows a preferred cross sectional configuration of the lower end portion 19 of the probe assembly.

The probe includes a front surface portion 32 and a rear surface portion 33.

These portions are situated one upon each side of the vertical center line 34 and the front surface portion, in this embodiment, is semi-circular when viewed in cross section whereas the rear surface portion 33 is a tapered or streamlined configuration which facilitates the mobility of the probe through the sand.

Figure 2:
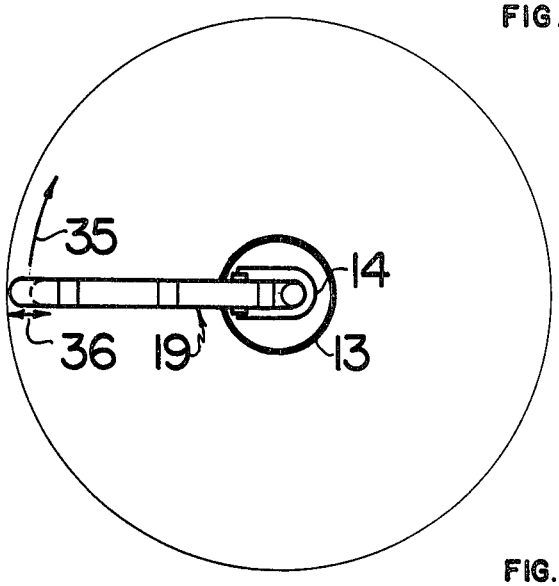
FIG. 2 is a schematic plan view showing the arc through which the lower end portion of the probe assembly travels.

It will also be observed that there is more surface area of the tapered portion 33 at the rear of the center line 34 than there is in front of the center line 34. Therefore, the lesser surface of the front surface portion 32 presents less friction to the movement of the probe than the surface of the rear surface portion 33. This means that the probe will move in the direction of the arrow 35 and, if situated horizontally as illustrated in FIG. 5, will move around in a circle in the direction of arrow 35 as indicated in FIG. 2, said circle having as a center, the vertical axis of the directional casing 14.

The lower end portion of the probe assembly can also be moved within limits, in the direction of double headed arrow 36 merely by the lowering device (not illustrated) provided on the surface thus giving a sawing action to the probe and facilitating the initial positioning thereof as illustrated in FIG. 1.

An oil-from-sand separating fluid or gas, or combination, is also fed downwardly through the vibrating probe assembly casing 20 to the lower end portion 19.

A longitudinally extending bore or drilling 37 is formed through the portion 33 of the lower end portion of the probe assembly and exits at the distal end as indicated by reference character 38. If desired, other drillings or bores such as 39 may extend between the bore 37 and the surface of the lower end portion of the probe assembly to further distribute this fluid. The fluid takes the form of steam, solvent or other fluid which will assist in the separation of the oil from the sand particles.

In the present embodiment, a steam generator 39A is provided on the surface and steam is conveyed via conduit 40, to the casing 20 and thence to the lower end portion through the bore 37.

This, together with the vibration effect of the lower end portion of the probe assembly, fluidizes the sand immediately surrounding the lower end portion thus facilitating the movement of the lower end portion through the sand bed. This movement maintains the lower end portion of the probe assembly in contact with the working face of the tar sand being treated.

As the oil is separated from the grains of sand in the fluidized area surrounding the lower end portion 19, this oil together with the fluid or steam used to separate the oil from the sand, floats towards the directional casing 14 and floats upwardly to the surface where it may be separated in a separator such as that illustrated schematically by reference character 40A.

The water level is constantly maintained to fill the voids created by the removal of the bitumen or oil and to keep the lower end portion 19 of the probe which is buoyant, at the working face illustrated in FIG. 1 by reference character 41.

In this regard, cold water is fed downwardly through the directional casing 14 by means of conduit 42 leading to the surface and this conduit discharges below the directional casing as illustrated by reference character 43.

The cold water is carried to the base of the sands by the conduit 42 and this elevates the hot water layer 44 caused by the condensation of the steam, and also elevates the lower end portion 19 of the probe assembly thus keeping in contact with the working face 41. The granular nature of the sand effectively prevents convection currents from mixing the hot water layer 44 with the colder water layer below and heat losses are therefore minimal.

By keeping the lower end portion 19 in the horizontal position illustrated in FIG. 5, and by raising same gradually as it rotates, the entire layer of tar sand can be treated and the oil removed therefrom.

Figure 4:
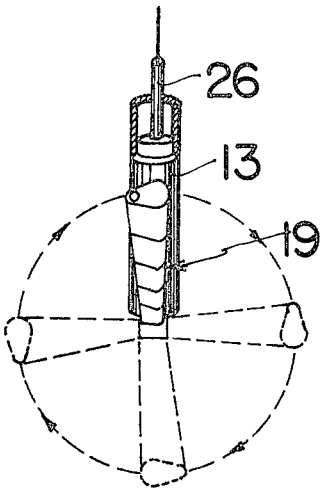
FIG. 4 is a schematic end view of the lower end portion of the probe showing how it can be moved relative to be horizontal.

However, if desired, the buoyancy of the lower end portion can be overcome by directing the probe from the horizontal. This is effected by rotating the probe assembly axially slightly so that the front of the probe assembly points upwardly or downwardly as illustrated in FIG. 4 so that the probe can be directed as desired.

As mentioned previously, steam, solvents or chemicals or any combination of same can be fed to the lower end portion 19 as hereinbefore described.

FIGS. 7 and 8 show an alternative method of providing vibrations to the lower end portion of the probe assembly. In this embodiment, the lower end portion is manufactured from a flexible plastic rubber or similar material in the configuration illustrated in FIG. 8.

Under normal conditions, the bore 45 is substantially oval in configuration when viewed in cross section although other configurations can be utilized.

The lower end portion may be metal sheathed if necessary, with small independent steel plates (not illustrated) to permit flexibility and reduce abrasion. These plates may be moulded or vulcanized to the outer surface of the probes by methods which are well known and it is not considered necessary to describe same further.

This particular embodiment is made to vibrate by filling the bore 45 with a fluid or gas, together with the conduit 20 which extends to the surface and which, in this embodiment, is connected by means of a conduit 46, to a cylinder 47 having a piston 48 reciprocal therein by means of a source of power 49.

This is a closed system so that when the piston moves in the direction of arrow 50, the fluid or gas within the lower end portion of the probe is compressed thus causing a rise in pressure within the lower end portion of the probe. As the pressure rises, the bore 45 is forced outwardly as shown by the dotted lines in FIG. 8 and in the direction of arrow 51 which in turn draws the ends of the chamber walls inwardly to form a substantially circular bore or chamber as shown in phantom. As a circle enclosed the greatest area for a given perimeter, the pressure will force the volume of the probe to its maximum thus forming the basically cylindrical circular chamber illustrated in phantom in FIG. 8. When the pressure is released by movement of the piston in a direction opposite to arrow 50, the resiliency of the material forming the lower end portion of the probe assembly will return it to the position shown in full line in FIG. 8. The rapidly changing shape of the bore or chamber 45 will cause the probe to lengthen as illustrated in FIG. 7 by reference character 52 so that a lengthwise oscillation will also occur. The frequency of oscillation or vibration can be controlled by controlling the speed of the piston 48 in cylinder 47.

Should structural strength be required to prevent the sand from crushing this particular embodiment of the probe, relatively short sections of steel tubing or rod 53 in end to end relationship to one another, can be inserted within the bore or chamber 45. These tubes or rods will have a diameter equal to the minor diameter of the substantially oval chamber or bore 45.

As mentioned previously, the cross sectional configuration of the lower end portion of the probe and particularly the cross sectional configuration of the bore chamber 45 can be varied providing it will change its shape under pressure and can be used to generate the required probe vibration.

Figure 9:
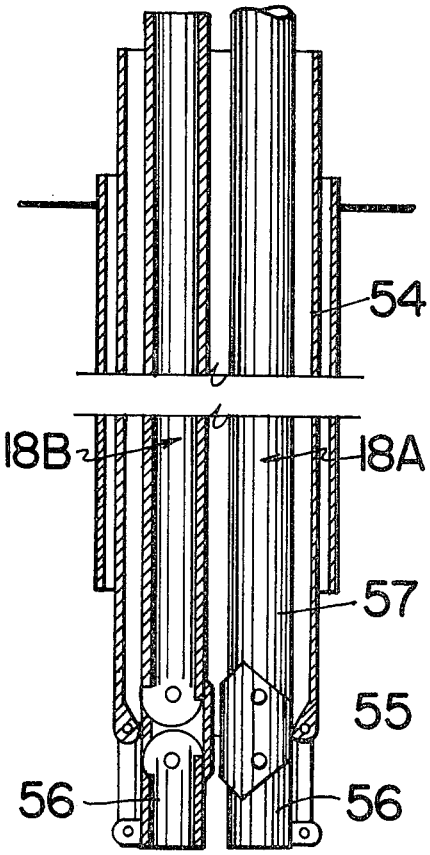
FIG. 9 is a fragmentary cross sectional view of part of the vibrating probe assembly illustrating a plurality of probe assemblies in a common casing and showing same in the vertical or inserting position.
Figure 10:
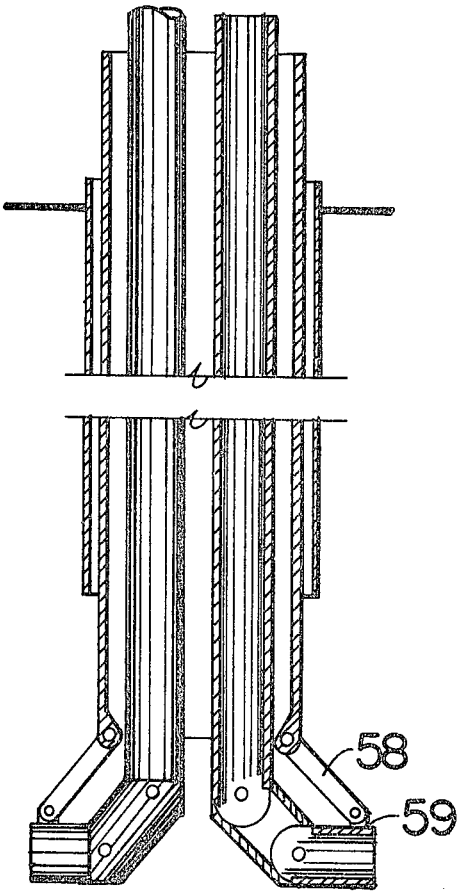
FIG. 10 is a similar view to FIG. 9 but showing the lower end portion extending at right angles from the main portions of the probe assemblies.

FIGS. 9 and 10 show a method of using a number of vibrating probe assemblies originating within the same well bore 13.

In the present embodiment, two such vibrating probe assemblies are shown, namely 18A and 18B situated in side by side relationship within an additional tubular casing 54.

Extending segments 55 and 56 are pivotally secured to the lower ends of the tubular portions 57 of the vibrating probe assemblies and constitute the lower ends of the directional casings similar to end 16 hereinbefore described.

Links 58 are pivotally connected by one end thereof to the lower end of the additional casing 54 and by the other end thereof to adjacent the outer ends 59 of the segments 56.

The assembly is lowered into the bore hole by attaching a conventional lowering device to the upper ends of the directional casings of the vibrating probe assemblies. The weight of the additional casings 54 pressing down on the links 58, will keep the extended sections 55 and 56 vertical with the bores of the directional casings thus permitting the assembly to enter the bore as illustrated in FIG. 9. When the unit has reached the sand bed, the casing 54 is held solidly in place at the surface by conventional means (not illustrated). The directional casings are then lowered so that the thrust on links 58 is reversed and the extension sections 55 and 56 are then forced into the right angled elbow position shown in FIG. 10 extending substantially at right angles and below the lower ends of the casing 54. The probe units can then be inserted into the directional casings and thence into the sand bed so that by using this method and a larger well bore, a number of probes can be used at the same time to work the sand bed from a single bore.

From the foregoing it will be appreciated that a method and apparatus is provided including a vibrating probe to scrub, wash and separate the oil from the sand and to repack the sand in situ. Although the term "oil" is used thoughout the specification, nevertheless this term is meant to include oil or bitumen or any other mineral separated from the sand by this process. p The vibrating probe assembly is mobile because of its shape and can be made to move in any direction by vibrating alone when immersed within the tar sand or similar material.

The buoyancy of the vibrating probe assembly, which through vibration, gives the sand a fluidity surrounding the probe, is also able to use the positive buoyancy of water to float while immersed in the sands thus maintaining the lower end of the probe assembly against the working face.

In addition, the probe assembly can use steam, hot water, gas, solvents, chemicals or other solutions to increase the boring capabilities and to increase the separation of the oil, bitumen or the like from the sand grains.

The vibrating probe assembly creates an open channel in the tar sand in the proximity of the probe to allow the minerals, bitumen or oil, to flow freely from the sand bed back to the well bore hole and thence to the surface and the vibration which not only causes the washing and scrubbing action, also assists in the repacking of the clean sand in situ.

Although the description and the drawings refer to the device for use in tar sands, mineral formations and the like, it should be noted that the vibrating probe device can be used in other environments such as manufacturing maintenance etc. As an example, it could be used for cleaning sludge or the like from pipes, channels etc. such as encountered in sewer or effluent treatment facilities.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. Apparatus for the separation of oil and the like from tar sands comprising in combination with a source of power, a substantially cylindrical directional casing, adapted to be placed within a well bore in said tar sands, a vibrating probe assembly engaged within said casing, means at the lower end of said casing to control the radial direction of the lower end portion of said probe assembly exiting therefrom, means to provide vibration to said lower end portion and means to convey an oil-from-sand separating fluid to said lower end portion and to discharge same therefrom into the tar sand immediately adjacent said lower end portion, said lower end portion having a configuration whereby the vibration thereof moves said lower end portion in a circle around the vertical axis of said directional casing, said lower end portion, when viewed in cross section, including a front surface portion which is substantially semi-circular and a tapered streamlined rear surface portion having a greater surface area than said front surface portion whereby said front surface portion presents less frictional resistance to the sand so that said probe, when vibrated, moves in a direction parallel to the transverse horizontal axis of said probe.

2. The apparatus according to claim 1 which includes further means to control, within limits, the direction of travel from the horizontal, of said lower end portion.

3. The apparatus according to claim 1 which includes means to convey cold water downwardly through said directional casing to the tar sands below said lower end portion of said vibrating probe assembly.

4. The apparatus according to claim 2 which includes means to convey cold water downwardly through said directional casing to the tar sands below said lower end portion of said vibrating probe assembly.

5. The apparatus according to claim 1 in which said lower end portion includes a plurality of sections operatively connected together in end to end relationship.

6. The apparatus according to claim 2 in which said lower end portion includes a plurality of sections operatively connected together in end to end relationship.

7. The apparatus according to claim 3 in which said lower end portion includes a plurality of sections operatively connected together in end to end relationship.

8. The apparatus according to claim 4 in which said lower end portion includes a plurality of sections operatively connected together in end to end relationship.

9. The apparatus according to claim 1 in which said cross sectional configuration of said lower end portion includes a front surface portion on one side of the vertical axix thereof and a rear surface portion on the other side of the vertical axis thereof, the shape of the surface portions being such that the area of said rear surface portion is greater than the area of said front surface portion, said front surface portion being substantially circular when viewed in cross section, said rear surface portion being substantially streamlined when viewed in cross section, said rear surface portion having a greater surface area than said front surface portion whereby said front surface portion presents less frictional resistance to the sand so that said probe, when vibrated, moves in a direction parallel to the transverse horizontal axis of said probe.

10. The apparatus according to claim 1 in which said means to vibrate said lower end portion includes a flexible drive shaft extending through said vibrating probe assembly and weights on the portion of said drive shaft within said lower end portion, said drive shaft being operatively connected to said source of power.

11. The apparatus according to claim 1 in which said means to vibrate said lower end portion includes at least said lower end portion being manufactured of a resilient material having a hollow longitudinally extending interior sealed at the distal end thereof, pulsating pump means operatively connected to said source of power, fluid conduit means extending from said pump means to said hollow interior of said lowere end portion, fluid within said pump means, said conduit means and said hollow interior, the cross sectional configuration of said hollow end portion being such that as the pump increases and decreases the pressure of the fluid therein, the external shape of the lower end portion changes thus causing the pulsating vibration, the frequency of which corresponds directly to the speed of said pump means.

12. The apparatus according to claim 11 which includes means within said hollow interior of said lower end portion to prevent collapse of said lower end portion due to sand pressure externally thereof, said last mentioned means including a plurality of short sections of solid material situated within said hollow interior in substantially end to end relationship one with the other.

13. The apparatus according to claim 1 in which said apparatus includes at least two vibrating probe assemblies in said directional casing, an actuating casing surrounding said vibrating probe assemblies, extending sections pivotally secured to the lower ends of each of said vibrating probe assemblies thereby constituting said lower end portions thereof, and linkage means operatively connected between the lower end of said actuating casing and the lowermost extending section of each of said vibrating probe assemblies whereby relative movement between said actuating casing and said vibrating probe assemblies moves said extending sections from a position substantially in alignment with said actuating casing to a position substantially at right angles thereto and extending outwardly beyond the lower end thereof, and vice versa.

14. The assembly according to claim 1 which includes a plurality of rollers journalled around the lower end of said directional casing to facilitate the movement of said lower end portion of said vibrating probe assemblies through said lower end of said directional casing.

15. A vibrating probe assembly for use within a semi-fluid environment which includes liquids and solids and for use with a source of power; comprising in combination a portion having a configuration whereby the vibration thereof moves said portion in a predetermined direction within said environment, means to vibrate said portion, said portion including a front surface portion which is substantially semicircular and a tapered streamlined rear surface portion having a greater surface area than said front surface portion whereby said front surface portion presents less frictional resistance to the said environment so that said probe, when vibrated, moves in a direction parallel to the transverse horizontal axis of said probe, and means operatively connecting said probe to said source of power.

16. The assembly according to claim 15 which includes further means to control, within limits, the direction of travel from the horizontal, of said lower end portion.

17. The apparatus according to claim 15 which includes means to convey fluid through said portion and into the said environment surrounding said portion.

18. The assembly according to claim 15 in which said lower end portion includes a plurality of sections operatively connected together in end to end relationship.

19. The assembly according to claim 15 in which said cross sectional configuration of said lower end portion includes a front surface portion on one side of the vertical axis thereof and a rear surface portion on the other side of the vertical axis thereof, the shape of the surface portions being such that the area of said rear surface portion is greater than the area of said front surface portion, said front surface portion being substantially circular when viewed in cross section, said rear surface portion being substantially streamlined when viewed in cross section, said rear surface portion having a greater surface area than said front surface portion whereby said front surface portion presents less frictional resistance to the said environment so that said probe, when vibrated, moves in a direction parallel to the transverse horizontal axis of said probe.

20. The assembly according to claim 15 in which said means to vibrate said lower end portion includes a flexible drive shaft extending through said vibrating probe assembly and weights on the portion of said drive shaft within said lower end portion, said drive shaft being operatively connected to said source of power.

21. The apparatus according to claim 15 in which said means to vibrate said portion includes at least said portion being manufactured of a resilient material having a hollow longitudinally extending interior sealed at the distal end thereof, pulsating pump means operatively connected to said source of power, fluid conduit means extending from said pump means to said hollow interior of said portion, fluid within said pump means, said conduit means and said hollow interior, the cross sectional configuration of said hollow end portion being such that as the pump increases and decreases the pressure of the fluid therein, the external shape of the portion changes thus causing the pulsating vibration, the frequency of which corresponds directly to the speed of said pump means.

22. The assembly according to claim 21 which includes means within said hollow interior of said portion to prevent collapse of said portion due to pressure externally thereof, said last mentioned means including a plurality of short sections of solid material situated within said hollow interior in substantially end to end relationship one with the other.

* * * * *